US005435628A

United States Patent [19]

Montgomery et al.

[11] Patent Number: 5,435,628

[45] Date of Patent: Jul. 25, 1995

[54] UNDERGROUND HYDRAULIC MINING METHOD AND APPARATUS

[75] Inventors: Warren G. Montgomery, Glade Springs, Va.; Price M. Campbell, Poteau, Okla.

[73] Assignee: Hydro Extraction Inc., Poteau, Okla.

[21] Appl. No.: 226,556

[22] Filed: Apr. 12, 1994

[51] Int. Cl.[6] ..... E21C 25/60; E21C 35/24; F21B 21/14

[52] U.S. Cl. ..... 299/17; 175/212

[58] Field of Search ..... 299/4, 17; 175/67, 212, 175/213; 166/177, 372

[56] References Cited

U.S. PATENT DOCUMENTS

| | | | |
|---|---|---|---|
| 3,030,086 | 4/1962 | Donaldson | 299/17 X |
| 3,790,214 | 2/1974 | Kilroy | 299/8 |
| 3,797,590 | 3/1974 | Archibald et al. | 175/213 |
| 3,993,354 | 11/1976 | Kilroy | 299/19 |
| 4,092,045 | 5/1978 | Sullivan | 299/17 |
| 4,094,549 | 6/1978 | Shoji et al. | 299/17 |
| 4,496,191 | 1/1985 | Choi et al. | 299/17 |
| 4,536,035 | 8/1985 | Huffman et al. | 299/17 |
| 4,708,395 | 11/1987 | Petry et al. | 299/17 |
| 4,915,452 | 4/1990 | Dibble | 299/17 |
| 5,246,273 | 9/1993 | Rosar | 299/17 X |

*Primary Examiner*—David J. Bagnell
*Attorney, Agent, or Firm*—J. Stewart Brams

[57] ABSTRACT

An underground method and apparatus for recovery of mineral deposits from sloping seams including high pressure water jet mineral dislodgement from underground deposits and water borne transport of dislodged mineral to an underground recovery site, and compressed air injection for transport of water borne mineral deposits from the underground recovery site to the surface.

23 Claims, 6 Drawing Sheets

UNDERGROUND HYDRAULIC MINING METHOD AND APPARATUS

BACKGROUND OF THE INVENTION

In the mining arts it is well known that underground mineral deposits, coal for example, may often be found in seams which slope with respect to the horizontal. Although conventional underground coal mining machinery is commonly used in essentially horizontal coal seams, for example those with a slope less than approximately 4° to 5° with respect to horizontal, such conventional machinery is not well adapted for use in seams with a greater slope, for example a 5° or 6° or greater slope with respect to horizontal.

This is so because conventional mobile underground mining machinery is commonly supported on the mine floor by rubber tires, tracks, or other suitable traction apparatus. The considerable weight of such mining machinery, together with the non-uniformities of the mine floor, and the inherent lubricity of the mine water on the mine floor, all tend to limit the utility of conventional mining machinery on slopes greater than approximately 5° or 6° with respect to horizontal. The machines will tend to slide down-slope in response to the reaction forces of the mining operation, or merely as a result of traction loss during movement of the mobile machine from one site to another in the mine. This diminished mining machine stability on a sloping mine floor is of great concern in view of the limited space and light in an underground coal mine. Obviously, machine instability increases the danger of working around the mining machinery.

Notwithstanding the impracticality of conventional mining machines for use in sloping seams, recovery of coal from sloping seams is contemplated by the prior art. For example, U.S. Pat. No. 4,536,035 discloses a hydraulic mining method which includes drilling a vertical bore hole from the surface into a pitched mineral vein, and a slant bore hole also drilled from the surface along the footwall of the vein to intersect the vertical bore hole. The slant bore hole accommodates a fluid jet stream apparatus to remove material from the mineral vein. The mineral and water mix flows down the slant bore hole into a sump formed by the vertical bore hole and is then pumped up through the vertical bore hole to the surface.

U.S. Pat. No. 4,092,045 discloses a subterranean hydraulic mining system in which a shaft is sunk from the surface into the mineral deposit. A second shaft is drilled from the surface into the same deposit in proximity with the first shaft. Shaped charges are utilized to disintegrate material in the deposit and subsequently water and air are utilized to move the disintegrated material toward the first shaft for recovery of the material by pumping thereof to the surface.

Other patents relating to hydraulic or water jet mining include U.S. Pat. Nos. 4,915,452, 3,797,590, 4,496,191, 4,094,549, 3,993,354 and 3,790,214.

BRIEF SUMMARY OF THE INVENTION

The present invention contemplates a novel and improved method and apparatus for recovery of mineral deposits such as coal from sloping seams in which conventional mobile mining machinery cannot be used. The invention contemplates a novel and improved mine development scheme or method which minimizes mineral recovery cost and thus improves the efficiency of mining operations. The invention further contemplates a novel high pressure water jet apparatus and method for dislodging coal from a sloping seam and transporting the coal to an underground recovery site, as well as a novel method and apparatus for transporting the coal from the underground recovery site to the surface. With this invention, more complete and efficient coal extraction may be achieved with minimal energy requirements as well as minimal surface disturbance.

The extraction method and apparatus of the present invention are operated by an operator at the surface with greatly improved reliability through direct visual observation of the underground site. The operator is among few workers required to pursue the method of this invention; hence, coal extraction according to this invention is more efficient and economical not only for its reduced energy costs but for reduced manpower requirements as well.

It is therefore an object of the present invention to provide a novel and improved method of extracting mineral matter from an underground deposit and a system not requiring employment of persons below the surface.

A more specific object of the invention is to provide a novel and improved method for recovery of mineral matter from a sloping or pitched seam of an underground deposit.

A further object of the invention is to provide a novel and improved apparatus for extracting mineral matter from an underground deposit.

A related object of the invention is to provide novel and improved means for transporting recovered mineral matter from an underground site to the surface.

These and other objects and further advantages of the invention will be more readily appreciated upon consideration of the following detailed description and the accompanying drawings, in which.

Figure 1:
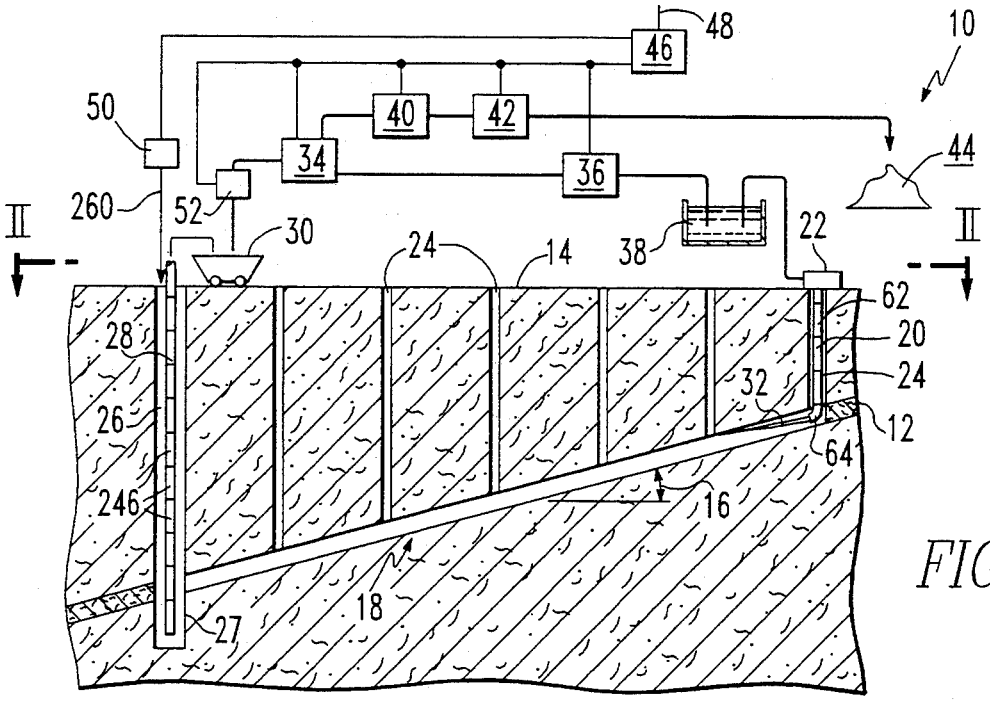
FIG. 1 is a generally schematic view of an underground extraction system according to one presently preferred embodiment of the instant invention.

In the drawings, which are not to scale, there is generally indicated at 10 in FIG. 1 an extraction system according to the method and apparatus of the present invention. The invention is of particular utility for recovery of mineral matter, coal for example, from a sloping seam 12, located underground at a depth of, for example, 200 to 1000 feet from the ground surface 14 and sloping at an angle of, for example, 5° to 45° with respect to horizontal as indicated at 16. The cited depth and angle of slope or pitch of mineral seam 12, like all other parameters and dimensions specified hereinbelow, are merely exemplary and are not intended to limit the scope of invention unless specifically included in the claims appended hereto.

Extraction system 10 comprises the development indicated generally at 18. A subterranean production tool string 20 extends from a surface operating location 22 into mineral seam 12 within one of a plurality of vertical bore holes 24 which extend from the surface downward into the mineral seam 12. The bore hole 24 having tool string 20 therein is shown enlarged in diameter merely for clarity. All the bore holes 24 are preferably of the same diameter. The development 18 further comprises a sump bore hole 26 which extends from the surface 14 downwardly to seam 12, and having a sump portion 27 which extends downwardly beyond seam 12 to a depth of, for example, 20′ to 50′ below seam 12. A mineral recovery tool string 28 extends within sump bore hole 26 and is utilized to transport mineral recovered from seam 12 to the surface 14. The recovered mineral is deposited in a collection apparatus 30 and then processed for shipment.

The method of the present invention generally involves use of a high pressure water stream 32 emanating from a nozzle 64 at the lower end of production tool string 20 to dislodge coal from seam 12 and form therewith a slurry. The slurry of water borne coal flows downgrade in previously worked areas of seam 12 into the sump portion 27 of bore hole 26 for transport via recovery tool string 28 to the surface facility 30. Accordingly, in addition to surface operating station 22 and collection apparatus 30, above-ground elements of mining system 10 include a dewatering apparatus 34, a centrifuge for example, which separates the water and coal slurry into coal particles and water. The water is directed to a treatment facility 36 where, among other operations, the water may be treated to neutralize acid picked up from the coal. The treated water is directed to a storage facility 38, an artificial pond for example, and may be drawn from storage facility 38 as needed to supply water for the production tool string 20. The water supply thus is continuously recycled through the mining operation.

Above ground components of mining system 10 may further include a heavy media separation facility 40 for separating rock partings and the like which may have become entrained in the water borne coal slurry during operations, and a crusher 42 for reducing the recovered coal to a suitable, desired particle size, to the extent this has not been achieved spontaneously in the recovery operation. The coal is then transferred to a stock pile 44 to await shipment.

Various power systems are required, as indicated schematically at 46, to power the various operations of the mining system 10. Power system 46 may include sufficient transformer capacity, for example two 2000 KVA transformers, connected to an incoming power line 48. Power requirements at the surface operating or production site 22 may include a main pump control operating one or more pressure pumps, for example two 1250 horsepower pumps to generate the high pressure water stream 32, and a suitable hydraulic oil pressure pump such as a 10 horsepower pump to hydraulically adjust the high pressure water nozzle 64 as described hereinbelow. In addition, suitable lighting and power for a video monitoring system is required both at surface production site 22 and in coal seam 12 at the lower end of tool string 20, as described hereinbelow.

Power distribution to sump borehole 26 may include power for suitable air compression capacity, for example three 100 horsepower air compressors as schematically indicated at 50, and for suitable slurry pumps, for example three 100 horsepower slurry pumps, as indicated at 52. The air compressors 50 supply compressed air to the lower end of recovery tool string 28 for injection of compressed air into the coal and water slurry to transport the slurry from sump 27 to the surface as described hereinbelow. Slurry pumps 52 are utilized to transport the water borne coal slurry from collection facility 30 on the surface to dewatering facility 34. An additional power requirement at sump bore hole 26 is electrical or fluid power to operate an agitator disposed at the lower end of recovery tool string 28.

Power requirements for other components of the extraction system 10 may include, by way of example, a 30 horsepower pump for makeup water requirements, one or more 25 horsepower pumps for circulating reclaimed water in pond 38, one or more 100 horsepower pumps for circulating water back to the production process, a 40 horsepower elevating conveyor for moving the processed coal to stock pile 44, and a 40 horsepower dewatering screen apparatus and 40 horsepower centrifuge apparatus for separating the water borne coal slurry into unprocessed coal and water components. Conventional 120 volt power for lighting at all operating stations in the extraction system 10 is also provided, as needed.

THE METHOD

Mining system 10 operates according to a novel mining method which is well adapted to the efficient extraction of coal from a sloping seam 12. The method involves both the actual mechanics of dislodging the coal from the seam 12, transporting it to a collection site, and moving the collected coal to the surface. In addition, the method involves a novel manner of development as set forth hereinbelow. In addition to the disclosure immediately below, both the description hereinabove and that hereinbelow relating to the extraction apparatus are to be regarded as part of the method disclosure for the present invention.

Figure 2:
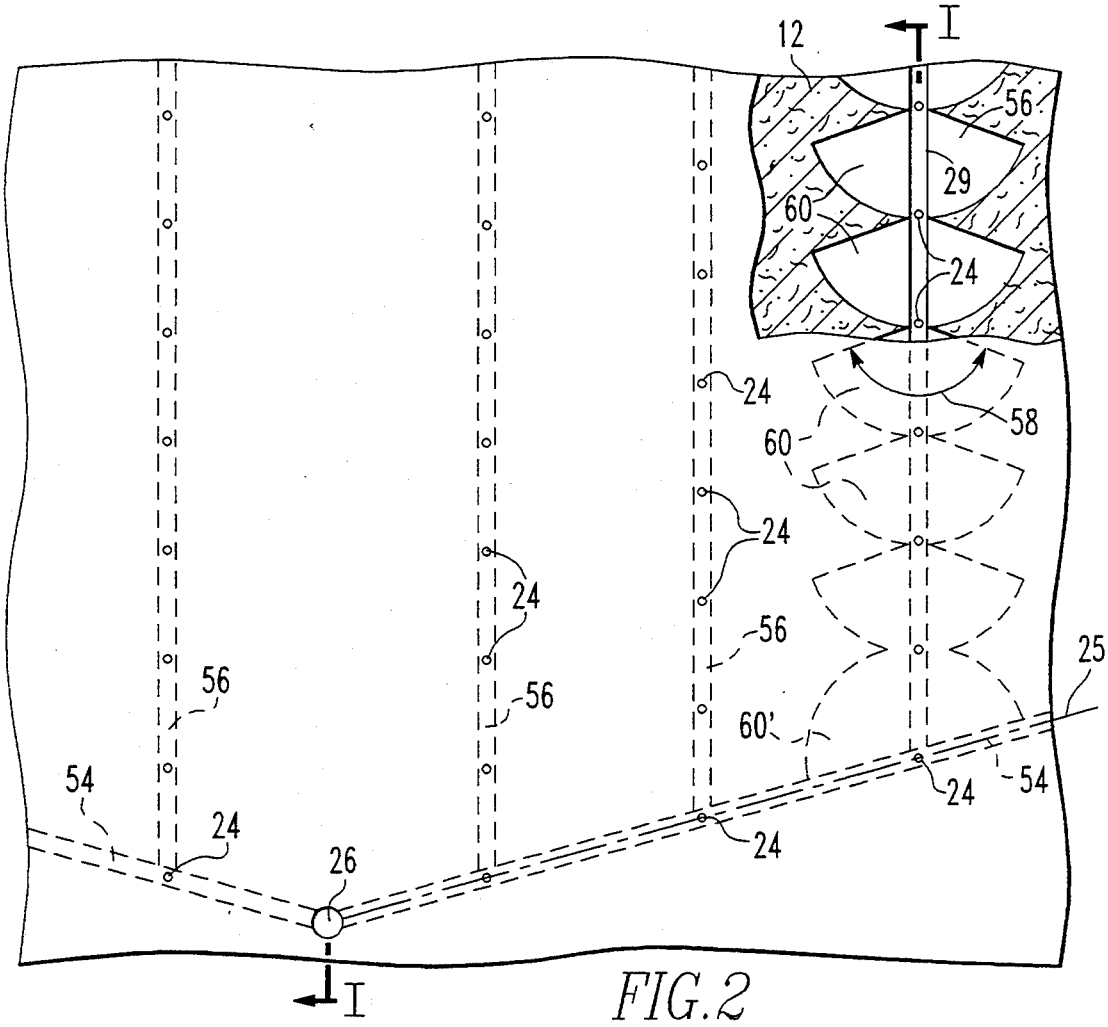
FIG. 2 is a top plan view of an extraction or recovery system taken generally on line II—II of FIG. 1.

Referring to FIGS. 1 and 2, recovery development is begun by sinking the sump bore hole 26, for example an 18″ to 20″ diameter bore hole, from the surface into and through coal seam 12 and to an elevation 20′ to 50′ below seam 12. The lower end sump portion 27 of bore hole 26 collects water borne coal slurry from upgrade locations in the hydro-extraction process.

Mine development continues by boring smaller diameter (e.g. 6″ to 7″, for example) vertical bore holes 24 into coal seam 12. Holes 24 are spaced apart at intervals of 50', for example, along a line 25 extending transversely across the pitch of coal seam 12 and partially in an upgrade direction. For example, the direction of line 25 extending from sump hole 26 may be such that the downgrade slope within seam 12 of a development header 54 developed therein directly beneath line 25 would be approximately 25% of the directly upgrade slope or pitch 16 of seam 12.

To work development header 54 such as above described, tool string 20 is lowered through the bore hole 26. Using the high pressure water jet apparatus the coal in seam 12 is progressively dislodged therefrom, working along the direction of line 25 for a distance of, for example 50'. At the outer end of the first 50' section of the development header 54, the first bore hole 24 is drilled. The tool string 20 is lowered through the first bore hole 24 and is used to work a second 50' increment of development header 54. Then the bore hole 24 next closest to sump hole 26 is drilled and is similarly used to excavate a third 50' increment of development header 54, and so on with the third and fourth bore holes 24 until a development header 54 of any desired length has been excavated through coal seam 12. This leaves a clear flow path throughout the entire length of development header 54 downgrade to sump bore hole 26. As shown, development header 54 extends to the right of sump bore hole 26; however, another development header extending to the left of sump bore hole 26 may be worked in an entirely similar fashion. Preferably, the development header 54 provides a clear cross sectional area of approximately 16 sq. ft.

With excavation of at least one development header 54, production extraction may proceed by working directly upgrade along the slope of seam 12 in one or more production headers 56. The production headers 56 may be developed in entirely the same fashion as set forth above for the development headers 54. That is, in sequence a plurality of vertical bores 24 are drilled from the surface into seam 12 at specified intervals, for example 50', along a line 29 extending directly upgrade with respect to the pitch of seam 12. The production tool string 20 is lowered through the bore holes 24 in succession, beginning with the bore hole 24 on development header 54, and through water jet use a passage is excavated in the directly upgrade direction along line 29 from development header 54. The next bore hole 24 is then drilled on line 29 directly upgrade from development header 54. The water jet extraction apparatus is lowered through this bore hole 24 and is used to work a section of seam 12 back toward the first bore hole 24 on development header 54. In an entirely similar process, the water jet apparatus is then used to work a section of the coal seam 12 from the next upgrade bore hole 24 back to the location of the bore hole next nearer development header 54. This process may be continued to develop production header 56 and extract coal from seam 12, working in the directly upgrade direction along line 29.

Since the bore holes 24 along both the development header 54 and production header 56 are spaced apart by a specified distance, for example 50' as noted, the water jet apparatus must be capable of dislodging coal from the seam 12 to a distance of 50 feet from the source of the water stream. More generally, whatever the chosen distance between bore holes 24, it must be chosen with attention to the effective distance capacity of the water jet apparatus utilized.

As noted, unlike operations in the development headers 54, operations in production headers 56 are not intended merely to open a passage back to development header 54, but rather to produce significant volumes of coal from seam 12. Accordingly, the water jet apparatus is adjustable to direct the water jet 32 radially throughout a large segment of a circle, for example 140° as indicated by angle 58 in FIG. 2. The water jet 32 is also vertically adjustable to dislodge coal throughout the entire height of seam 12 from its footwall to its headwall. The resulting fan-shaped mine galleries 60 are worked to the desired radius, 50' for example, as noted, until each gallery 60 breaks through to the preceding one at the location of the directly downgrade bore hole 24. The dislodged coal forms a slurry with the water stream which passes downgrade through the previously mined-out galleries 60 and into development header 54, and thence downgrade to sump hole 26 for ultimate removal to the surface.

If desired, the first gallery 60' off development header 54 may be worked from the corresponding bore hole 24 directly on development header 25 so that the fan-shaped gallery 60' is inverted, thereby creating an open area connected with development header 25 at the foot or base of production header 56.

When the limit of upgrade extension of the production header 56 has been reached the production header 56 may be further worked in somewhat the manner of retreat extraction to clear out residual coal deposit in the galleries 60. To do this, the water jet apparatus is employed in the furthest upgrade galleries 60 first, and then employed sequentially in adjacent galleries 60 working downgrade toward development header 54.

Other development headers 56 may be worked in the same manner. Further, at a location to the left or right of the furthest reach of either development header 54 another sump bore hole 26 may be driven and an additional section may be developed similarly to that discussed hereinabove. Still further, at selected locations directly upgrade of the described extraction section beyond the reach of production headers 56, or downgrade of the described section, still further extraction sections may be similarly developed with corresponding sump bore holes 26, left and right development headers 54, and directly upgrade production headers.

While the above description pertains essentially only to the method of the present invention, the description hereinbelow of novel apparatus utilized in carrying out the invention also includes disclosure of aspects of the novel method. Accordingly, all of the following disclosure is to be understood as disclosure of both method and apparatus.

THE APPARATUS

Tool string 20 is a production apparatus which is operable to dislodge coal from seam 12 by means of a high pressure water stream directed at the coal deposited in the seam, the tool string 20 being operated entirely from the surface location 22. As such, tool string 20 includes a water pipe 62 which extends the length of tool string 20 from surface location 22 into seam 12 where it terminates at a nozzle 64. Also extending the length of tool string 20 are suitable power conduits such as hydraulic hoses and electrical conductors to provide power for the adjustment of nozzle 64 and for remote video monitoring and lighting equipment adjacent to nozzle 64 within seam 12. As will be seen from further description hereinbelow, nozzle 64 is adjustable both up and down in a vertical plane, and rotationally about the vertical axis of pipe 62 in order to permit access to adjacent areas of coal seam 12 for extracting coal therefrom. Accordingly, at surface location 22 tool string 20 is also provided with apparatus for rotating the tool string 20 about a vertical axis.

Figure 3:
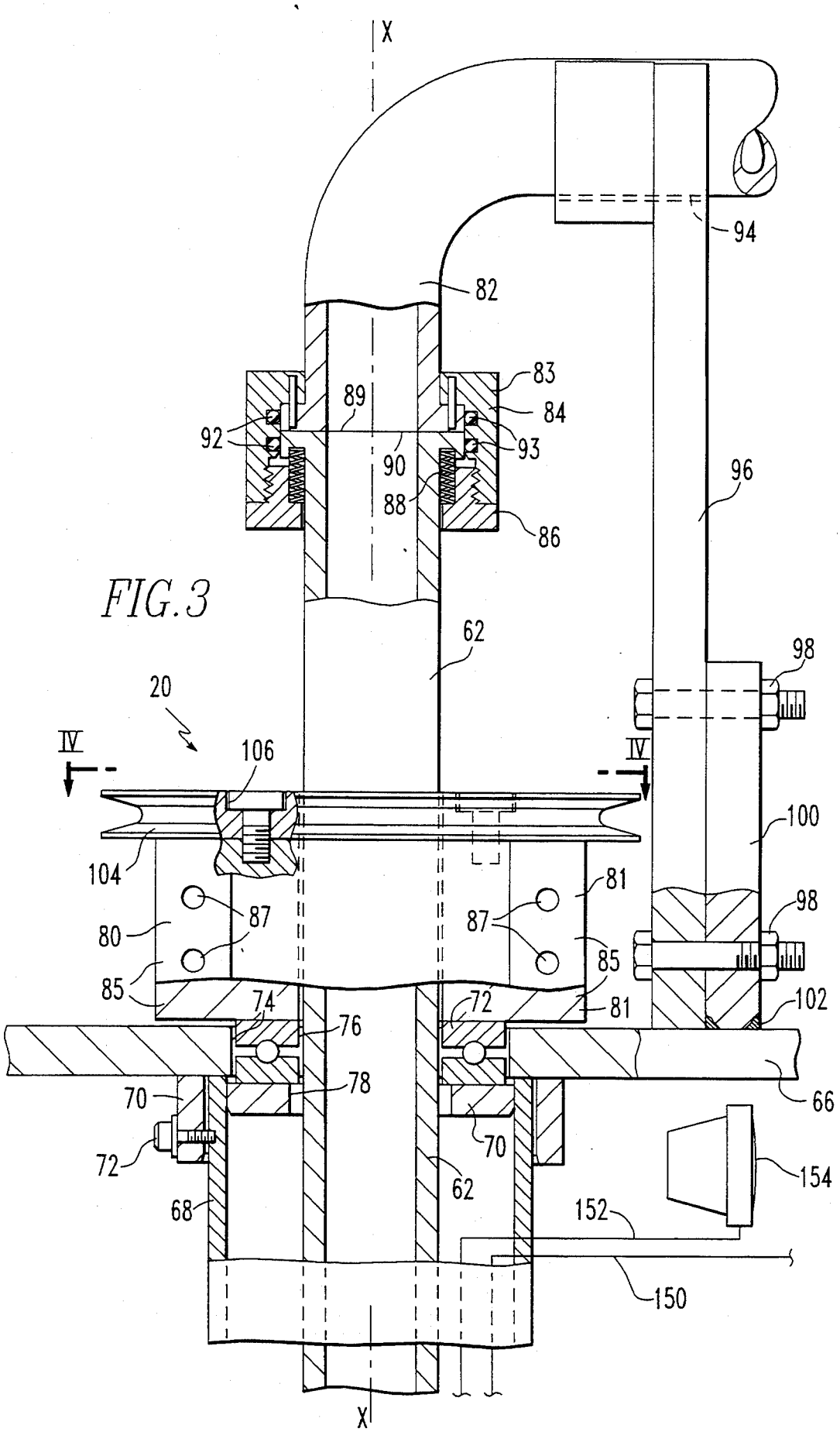
FIG. 3 is a partially sectioned side elevation of an upper end portion of a production tool string for use in the recovery system of FIG. 1.

More specifically, and referring to FIG. 3, the uppermost end of tool string 20 is shown as having a base plate 66 supported directly above bore hole 24 by engagement with a casing 68 that extends within the bore hole 24. For example, a collar 70 with set screw attachment 72 is affixed to an underside of base plate 66 and encloses an upper end of casing 68. A thrust bearing support member 70 is affixed within the upper end of casing 68, as by welding thereof for example, to support a thrust bearing 72 that resides within a suitable opening 74 formed in base plate 66 coaxially with casing 68. Similar coaxial openings 76 in thrust bearing 72 and 78 in thrust bearing support 70 accommodate passage of pipe 62 downwardly through casing 68.

To support the water pipe 62, a bolt-on pipe clamp 80 may be engaged about pipe 62. Clamp 80 includes a pair of essentially identical clamp halves 81, each having a pair of radially extending flange portions 85 with respective bores 87 which reside in mutual alignment to receive suitable clamping fasteners such as nut and bolt assemblies (not shown). The clamp 80 is supported on thrust bearing 72 so that essentially the entire weight of tool string 70 hangs from thrust bearing 72. To permit rotation of tool string 20 which is thus supported, thrust bearing 72 may be any suitable rotary bearing, for example a ball bearing or a tapered roller bearing of sufficient load capacity, consistent with the weight of the tool string 20 to be supported thereby.

The uppermost end of pipe 62 is connected to a water inlet pipe 82 by means of a suitable swivel connector having a body portion 84 and a cap portion 86 which cooperates with body 84 and with belleville springs 88 to maintain abutting ends 89 and 90 of respective pipes 82 and 62 in biased, swivel engagement. Body 84 also carries suitable ring seals 92 in respective annular grooves 93 to seal the junction between pipes 82 and 62 against leakage of water under high pressure from the swivel connection.

To support pipe 82 with respect to pipe 62, the pipe 82 may make a radiused right angle bend, adjacent to which it is supported as indicated at 94 by an upstanding, rigid support bracket 96. In turn, bracket 96 is rigidly retained with respect to base plate 66 as by nut and bolt assemblies 98 securing bracket 96 to an upstanding anchor plate 100 that is welded as indicated at 102 to base plate 66.

Figure 4:
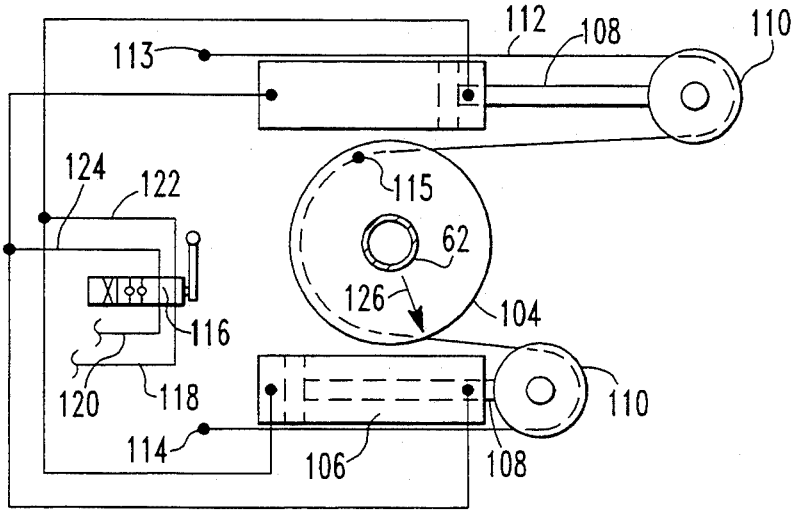
FIG. 4 is a partially schematic, fragmentary top plan view taken on line IV—IV of FIG. 3.

Referring to FIGS. 3 and 4, a suitable pulley 104 is affixed atop clamp 80 as by suitable threaded fasteners 106, for example, in coaxial relationship with pipe 62. A pair of hydraulically actuated piston and cylinder assemblies 106 are suitably mounted on base plate 66 at opposed sides of pulley 104. The rod portion 108 of each assembly 106 has a pulley 110 mounted adjacent its free end for rotation essentially in the plane of rotation of pulley 104. A suitable flexible line 112, for example a stranded wire rope of appropriate diameter and strength characteristics, is anchored at points 113 and 114 and extends therebetween about pulleys 110 and 104 as shown in FIG. 4. The line 112 is also anchored to the perimeter of pulley 104 as indicated at 115.

A suitable actuating circuit for hydraulic assemblies 106 comprises a three-way valve 116 connected to hydraulic fluid flow supply and return lines 118 and 120, respectively. Other hydraulic lines are connected between the supply and return ports of valve 116, and the respective hydraulic assemblies 106 as follows. A hydraulic fluid flow line or conduit 122 connects the supply port of valve 116 to the retraction port of one assembly 106, and the extension port of the other assembly 106. Similarly, a hydraulic fluid flow line or conduit 124 connects the return port of valve 116 to the remaining extension and retraction ports of respective assemblies 106.

With valve 116 in its center or neutral position, both hydraulic fluid supply and return flow are cut off and the assemblies 106 are locked in a given state of extension or retraction. When shifted to the position shown in FIG. 4, valve 116 supplies hydraulic fluid flow via line 122 to the assemblies 106 thereby extending piston rod 108 of one assembly 106 and retracting the piston rod 108 of the other. To accommodate this. motion, valve 116 simultaneously directs return fluid flow from the assemblies 106 via the conduit 124 to conduit 120.

When valve 116 is moved to its extreme opposite position, the flow path of hydraulic fluid supply and return flow is reversed as between conduits 122 and 124 so that the extension and retraction of the respective piston rods 108 of assemblies 106 is reversed.

This reversible extension and retraction of assemblies 106, one always extending while the other is retracting, pulls line 112 about pulley 104 in one rotary direction or the other, and since line 112 is anchored at 115 to pulley 104, this action also turns pulley 104 through a desired angle corresponding to the angle of sweep through which the operator wishes to direct the high pressure water jet within coal seam 12, for example a 140° angle of sweep as described hereinabove with reference to FIG. 2.

To permit visualization of the radial position of the high pressure water nozzle within mineral seam 12, a corresponding direction indicator such as shown at 126 in FIG. 4 may be provided on an upper surface of pulley 104, or alternatively on a part of pipe 62 which is visible to the operator. By means to be described hereinbelow, the individual pipe sections of tool string 20 register with one another in a non-redundant fashion so that the indicator 126 will always correctly indicate the radial position of the high pressure water jet nozzle within mineral seam 12.

Figure 5:
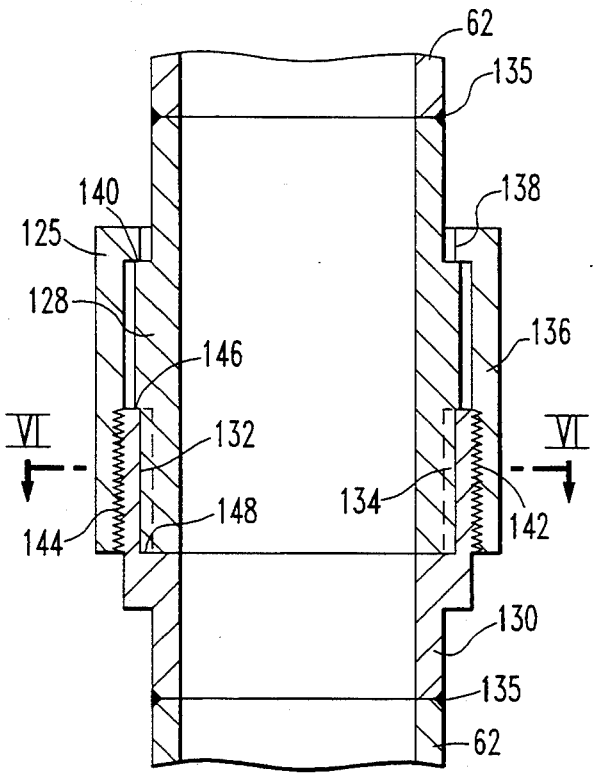
FIG. 5 is a sectioned side elevation of a pipe connector portion of the production tool string in the extraction system of FIG. 1.
Figure 6:
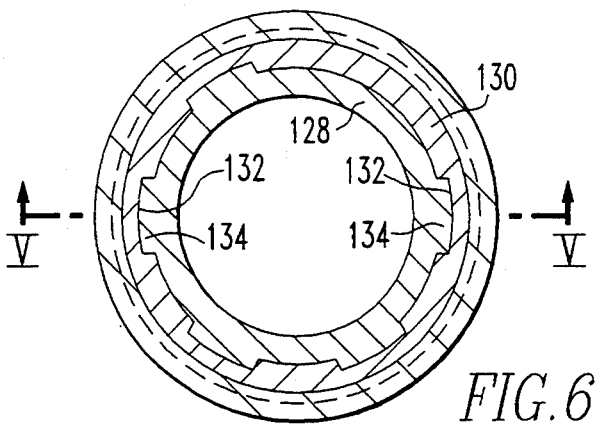
FIG. 6 is a sectional view taken on line VI—VI of FIG. 5.

Referring to FIGS. 5 and 6, a proper registry of the multiplicity of pipe sections making up tool string 20 are connected in non-redundant fashion by connector assemblies 125. More specifically, the adjacent ends of a pair of pipe sections 62 have welded thereto cooperating portions of a connector assembly 125 comprising a male connector portion 128 and a female connector portion 130. Mutually engageable portions of the connector portions 128 and 130 are provided with cooperating internal and external blind splines 132, 134 respectively. Splines 132 and 134 are circumferentially distributed about the respective inner and outer peripheries of connector portions 130 and 128 in asymmetrical fashion as shown in FIG. 6. The adjacent pipe sections 62 can thus be connected end to end in only a single, non-redundant configuration. Of course, each pipe section will have a male connector portion 128 affixed adjacent one end thereof as by welding indicated at 135, and a female connector portion 130 similarly affixed adjacent the opposed end thereof. Further, the male and female connector elements affixed to the opposed end of any pipe section 62 must be properly positioned with respect to one another so that the uniformity of pipe connections will be carried throughout the length of tool string 20 from the nozzle 64 at the lower end to the position indicator 126 at the upper end of the tool string 20.

A collar portion 136 of the pipe connector assembly 125 includes a flange portion 138 which engages an annular external surface 140 of male connector portion 128. Suitable internal threads 142 formed within collar 136 are engagable with cooperating threads 144 formed on the exterior periphery of female connector element 130. By tightening down the threaded engagement of collar 136 with female connector portion 130, flange 138 bears upon surface 140 thus urging the connector portions 128 and 130 into mutually biased, rigid engagement through axial, sealing abutment of respective annular bearing surfaces at 146 and/or 148.

Referring again to FIG. 3, the tool string 20 also includes, in addition to pipe string 62 extending within casing 68, hydraulic power conduit means, shown schematically at 150, and electrical conductor means shown schematically at 152. The hydraulic power conduit means 150 would preferably be a pair of hydraulic fluid conduits, one for supply flow to a hydraulic actuating cylinder and one for return flow, the supply and return functions of the conduits being reversible. The electrical conductor 152 powers both a remote video monitoring camera and high intensity lighting in seam 12 which facilitates video monitoring using conventional waterproof video monitoring and lighting apparatus as indicated schematically at 154. Alternatively, apparatus 154 may be a waterproof fiber optic visual monitoring device, thus requiring a fiber optic transmission cable extending lengthwise of tool string 20 in lieu of or in addition to electrical conductor 152.

Figure 7:
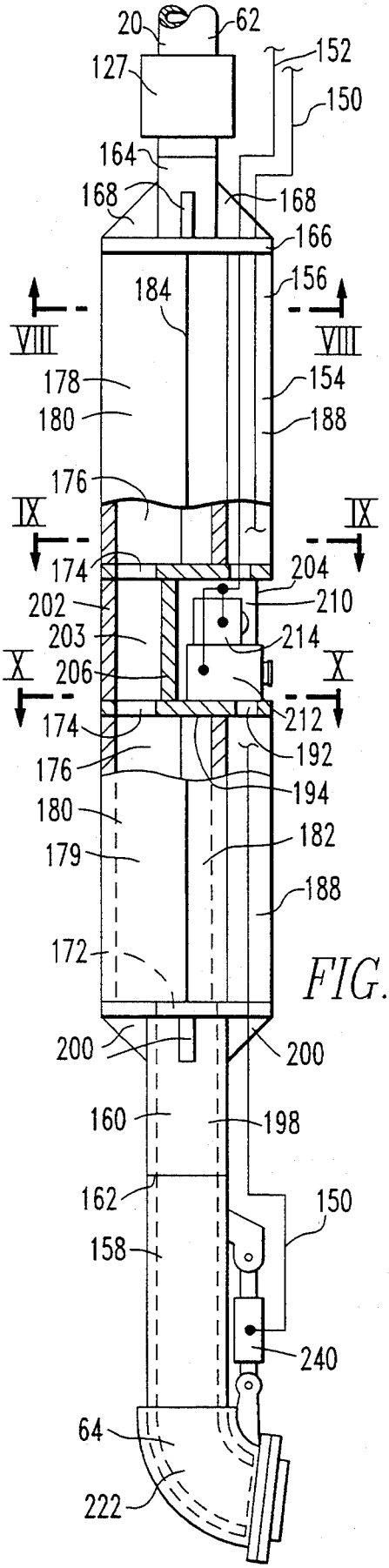
FIG. 7 is a partially sectioned side elevation of a lower end of the production tool string in the extraction system of FIG. 1.
Figure 8:
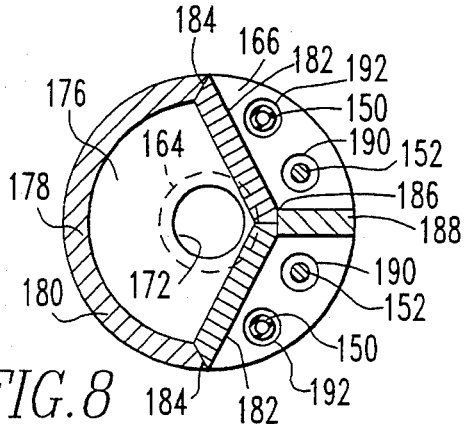
FIG. 8 is a sectional view taken on line VIII—VIII of FIG. 7.
Figure 9:
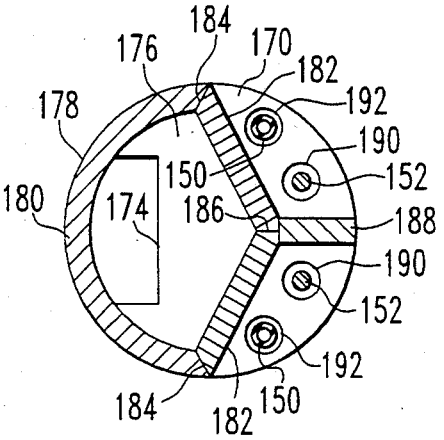
FIG. 9 is a sectional view taken on line IX—IX of FIG. 7.

Referring to FIGS. 7, 8 and 9, the lower end of production tool string 20 includes a connector 127 by which a tool assembly 154 is affixed to the free end of the last pipe section 62 in the tool string 20. Tool assembly 154 includes a fabricated pipe portion 156 and a nozzle portion 158 which includes nozzle 64. Portion 158 is affixed to a lower end 160 of fabricated portion 156 as by weldments 162.

The uppermost end of fabricated portion 156 includes a cylindrical pipe section 164 which is welded to a transverse circular plate 166, the connection of plate 166 to pipe 164 being strengthened by further welding of gussets 168. Spaced downwardly from plate 166 is a similar generally circular plate 170; however, whereas circular plate 166 includes a coaxial through opening 172 (FIG. 8) which communicates with the interior of pipe section 164, plate 170 includes an opening 174. The openings 172 and 174 in the respective plates 166 and 170 communicate with each other via a passage 176 that is formed by a fabricated pipe section 178 extending between the plates 166 and 170.

The fabricated pipe section 178 includes a generally semi-cylindrical pipe portion 180 extending circumferentially around approximately a 180° peripheral portion of each of plates 166 and 170. A pair of elongated rectangular plates 182 are coextensive with pipe section 180, each of plates 182 having one longitudinal edge thereof welded to one of the corresponding longitudinal edges 184 of pipe section 180 (FIGS. 8 and 9). The welds extend along the entire length of the respective adjoining edges. The remaining longer edges of plates 182 are joined and welded together along their entire length as indicated at 186. Finally, an elongated reinforcing plate 188 is coextensive with the mutually engaged and welded edges of plates 182 at 186, and is welded thereto and also to the plates 166 and 170. The entire structure of fabricated pipe portion 156 is welded up from components as described to provide the strength to support reaction forces of the water jet ejected from the nozzle 64 under high pressure, and to provide other functions described including a flow path 176 for the passage of water under high pressure from the last pipe section 62 toward the nozzle 64.

Each of circular plates 166 and 170 further includes a plurality of through openings to accommodate control and power lines. For example, each plate 166 and 170 may include a pair of through openings 190 to accommodate passage therethrough of electrical power lines and video signal transmission lines which service the video and lighting equipment to be described hereinbelow. Each of plates 166 and 170 may further include a pair of openings 192 to accommodate hydraulic fluid lines which power a hydraulically actuated nozzle adjustment apparatus to be described hereinbelow. The openings 190 and 192 all are preferably located outside of the passage or containment 176 formed by semi-cylindrical pipe section 180 and plates 182.

A second fabricated pipe section 179, similar to fabricated pipe section 178, is located beneath the fabricated pipe section 178 and in longitudinal alignment therewith. The longitudinally extending portion of the fabricated pipe section 179 extends between generally circular plates 194 and 196. Plate 194 is similar in most salient respects to plate 170, including the opening 174 and openings 192; however, plate 194 does not include openings 190 as the service lines for the above mentioned lighting and video equipment terminate above plate 194. Plate 196 is similar to plate 166 in that it has connected thereto a cylindrical pipe section 198 which forms the lower end portion 160 mentioned hereinabove, and gussets 200. The plate 196 includes a central opening 172 and openings 192 to accommodate hydraulic power lines as mentioned hereinabove; however, plate 196 does not include the openings 190 as the video and lighting equipment service lines terminate above plate 196.

Extending between the plates 194 and 196 is the balance of fabricated pipe section 179, made up of a semi-cylindrical pipe element 180 and a pair of elongated rectangular plates 182 cooperating to form a passage 176, and an elongated generally rectangular reinforcing member 188, essentially as above described with respect to the fabricated elements extending between plates 166 and 170; however, the overall length of fabricated pipe section 179, that is the distance between plates 194 and 196, is preferably shorter than the length of fabricated pipe section 178.

Figure 10:
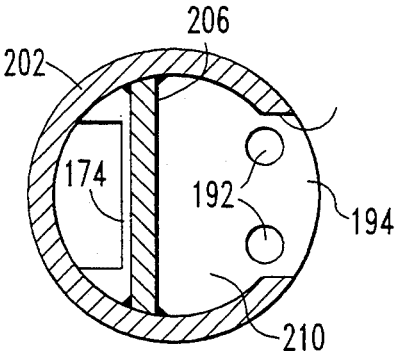
FIG. 10 is a sectional view taken on line X—X of FIG. 7.

Fabricated pipe sections 178 and 179 are joined by fabricated elements extending longitudinally intermediate plates 170 and 194 as follows. Referring to FIGS. 7 and 10, a partially cylindrical pipe section 202 extends longitudinally intermediate plates 170 and 194 generally in coaxial alignment with semi-cylindrical pipe sections 180; however, the cylindrical pipe section 202 subtends an included angle greater than the 180° subtended by semi-cylindrical pipe section 180. An opening 204 thus opens laterally out of one side of the pipe section 202.

A transverse wall 206 extends longitudinally intermediate plates 170 and 194 within the confines of cylindrical pipe section 202 and is welded about its entire periphery to plates 170 and 194, and to pipe section 202 to thereby form a closed passage 208 between openings 174 in plates 170 and 194. As will be appreciated, passages 176 and 208 form a continuous, fabricated water pipe which supports water flow between the stub pipe section 164 and stub pipe section 198, which in turn is connected to nozzle 64. On the opposite side of wall 206 a pocket 210 is formed partially within the confines of pipe section 202 and between the plates 170 and 194. Pocket 210 opens outwardly through opening 204 and is utilized to carry the video and lighting equipment 212, 214.

Power and signal transmission lines are indicated schematically at 152 in FIGS. 3 and 7. These extend the entire length of the tool string 20 and through the openings 190 in plates 166 and 170 to service the video and lighting equipment 212 and 214. Lighting equipment 214, which may be either high intensity visible lighting apparatus or infrared apparatus for example, serves to light the area of seam 12 to be worked so that it may be visually monitored by use of video equipment 212. Video equipment 212 may be either a conventional miniature video camera or such alternatives as for example, a fiber optic device. The remote video display 154 in FIG. 3 is selected to be compatible with the video and lighting equipment 212 and 214, as are the communicating lines 152.

Figure 11:
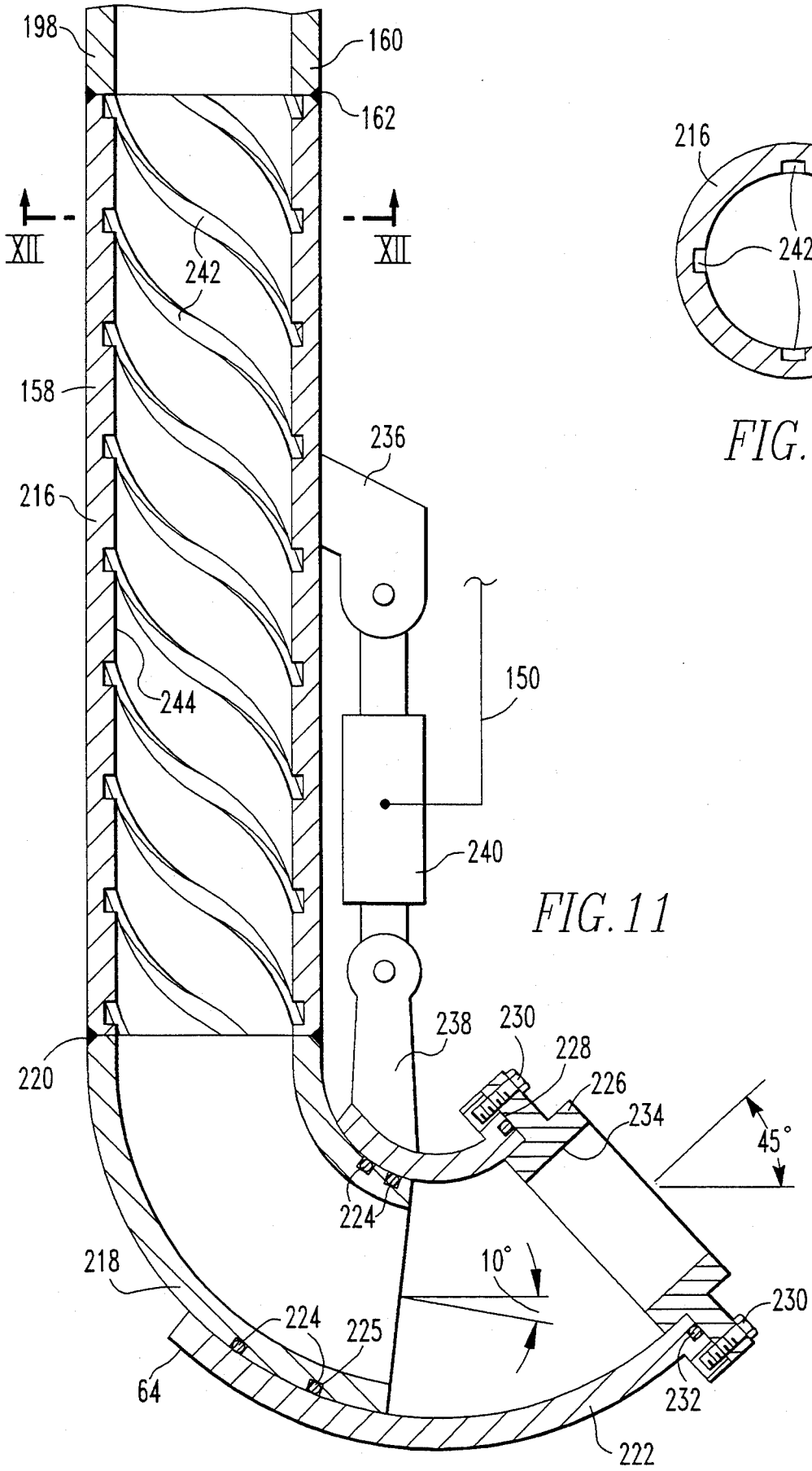
FIG. 11 is a sectional view of a lower end portion of FIG. 7.

Referring to FIG. 11, nozzle 64 includes an assembly 158 comprised of a generally straight pipe section 216 which is rigidly affixed as above described in coaxial alignment with the pipe section 198 by welds 162. A curved or radiused pipe section 218 is similarly affixed as by weldments 220 to the lower end of straight section 216, and an adjustable nozzle section 222 is overfitted upon curved section 218 and slidably disposed thereon for adjustment of its vertical angle of orientation with respect to the horizontal. Suitable O-ring seals 224 are disposed in external annular grooves 225 on curved section 218 to seal the interface between nozzle section 222 and curved section 218, and to accommodate the relative sliding movement therebetween.

A nozzle orifice member 226 is affixed to an outer or free end 228 of curved section 222 as by suitable threaded fasteners 230, and a suitable ring seal 232 seals the interface between orifice member 226 and curved section 222. A water outlet orifice 234 is formed in orifice member 226, the angle of which opening is adjustable within a vertical range, for example from a position 10° below horizontal to the position 45° above horizontal with the straight section extending perpendicular to the horizontal as shown in FIG. 11. This adjustment permits a water jet emanating from orifice 234 to be directed through a corresponding vertical range.

To actuate the described nozzle adjustment, a mounting lug 236 is suitably positioned and affixed with respect to straight nozzle section 216, and a second lug 238 is suitably positioned and affixed with respect to nozzle section 222. A hydraulically actuated piston and cylinder assembly 240 extends between and is pivotally affixed to each of the lugs 236 and 238, and hydraulic fluid control conduit means, indicated schematically at 150, supply hydraulic fluid for actuation of the piston and cylinder assembly 240 for vertical adjustment of nozzle orifice opening 234. As assembly 240 is extended, nozzle section 222 slides downwardly upon curved section 218 whereby the orifice opening 234 turns upward. Similarly, as piston and cylinder assembly 240 is retracted, nozzle section 222 slides upwardly on curved section 218 thus turning the nozzle opening 234 downward.

Control of the piston and cylinder assembly 240 in the manner described may be achieved through the expedient of any conventional, suitable hydraulic pump and a suitable control valve, for example a valve of the type illustrated at 116 in FIG. 4. The hydraulic lines 150 extend upwardly through openings 192 in all of plates 196, 194, 170 and 166, and further throughout the entire length of tool string 20 to the surface as indicated in FIG. 3.

Figure 12:
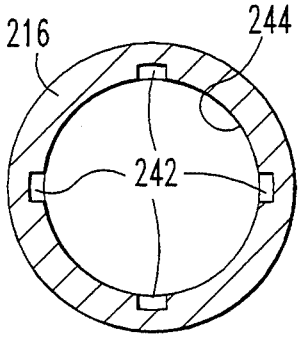
FIG. 12 is sectional view taken on line XII—XII of FIG. 11.

In order to better control the flow of high pressure water ejected from orifice 234, a plurality of spiral grooves 242 are formed in the interior cylindrical wall 244 of straight nozzle section 216, as shown in FIGS. 11 and 12. Grooves 242 impart a spiralling motion to the high pressure water jet as it passes through straight nozzle section 216. The spiralling water jet, once ejected through orifice 234, maintains greater coherence and is less subject to "brooming" or similar effects characterized by spreading or loss of coherence in the water jet. As a result, the water jet can produce a higher intensity impact on a mineral seam at a greater distance from the orifice 234 thereby improving the efficiency of the mineral disintegration operation and/or reducing the energy requirements of pressurized water flow per unit of mineral extracted from the seam.

Figure 13:
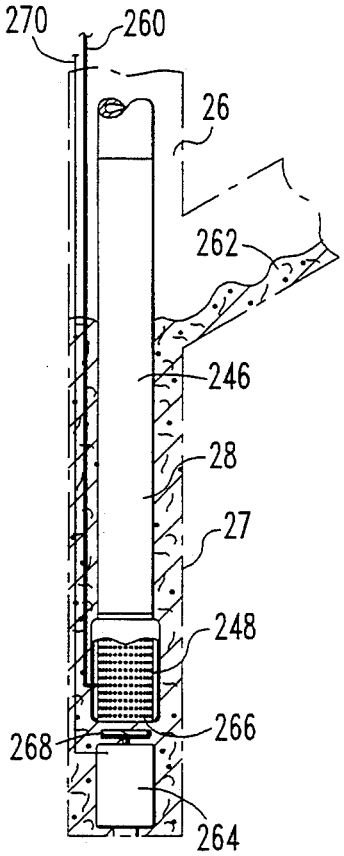
FIG. 13 is an enlarged fragmentary portion of FIG. 1 showing a mineral recovery sump and related apparatus.

Referring to FIG. 13, recovery tool string 28 extends within bore hole 26 into the sump portion 27 thereof. Recovery tool string 28 includes a string of connected pipe sections, the connections therebetween being of any suitable sort such as, for example, the pipe connection of FIG. 5, although for recovery tDO1 string 28 there is no need for any splined engagement to maintain uniform alignment of the pipe sections 246.

Figure 14:
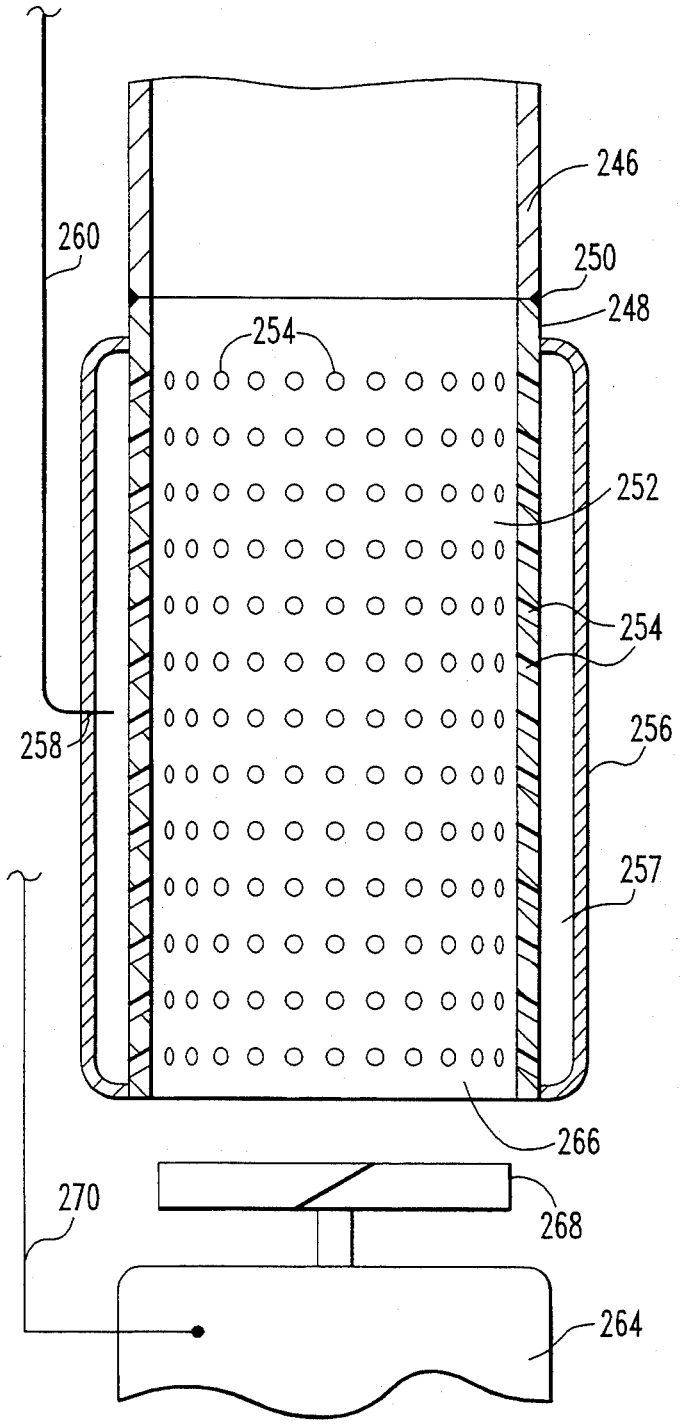
FIG. 14 is an enlarged, generally schematic fragmentary portion of FIG. 13.

Referring to FIGS. 13 and 14, a fabricated manifold assembly 248 is affixed coaxially to the lower open end of the final pipe section 246 in string 126 as by weldments 250, for example. Manifold 248 includes an inner, cylindrical member 252 which forms a cylindrical extension of pipe section 246. A plurality of suitably sized openings 254 penetrate the cylindrical member 252, extending upwardly preferably at an acute angle to the horizontal, in a radially inward direction. A manifold jacket 256 encloses a space 257 adjacent to the outer periphery of cylindrical member 252 and encompassing all of the openings 254 formed therein. An air inlet, indicated schematically at 258, accommodates a compressed air supply 260 from air compressors 50, as disclosed hereinabove.

Air supply line 260 supplies air to space 257 under pressure whereupon the air is ejected through openings 254 into manifold pipe 248. It will be understood that the water borne slurry of coal particles, indicated at 262 in FIG. 13, fills at least part of the sump bore hole 27 to a given level or elevation. Accordingly, manifold 248, and at least part of the adjacent pipe section 246 are immersed in the coal and water slurry. The upper end of pipe string 28 is vented so the slurry will spontaneously rise to essentially the same level within manifold 248 and the adjacent pipe section 246, whereupon the ejection of masses of compressed air bubbles through openings 254 into space 252 of manifold 248 creates a rising column of air bubbles which intermingles with the coal and water slurry. Since air has the property of buoyancy with respect to water, the injected air tends to rise through the coal and water slurry, thus carrying it to the surface through pipe string 28. More importantly, the volume of compressed air pumped into the manifold pipe 248 causes a high velocity flow of air upward through the pipe string to the surface. This high velocity air flow lifts the coal and water slurry to the surface.

It is believed a suitable number of openings 254 to achieve the air transport of water borne coal slurry at suitable recovery rates would be 500 to 700 such openings, with a compressed air injection rate and pressure as set forth hereinbelow.

Of course, the coal and water slurry will not spontaneously maintain its fluid state. That is, left undisturbed the coal particles will settle out of the water and tend to compact under their own weight. In order to maintain the fluid state of the slurry within sump 27, an agitator 264 is provided directly subjacent the lower open end 266 of manifold 248. Agitator 264 may be a waterproof electrical motor or a hydraulic or pneumatic motor, for example, which drives an agitating impeller 268, for example a rotary impeller as shown, which agitates the coal and water slurry and thereby maintains it in a fluid state. Suitable power means such as electrical conductors or fluid power lines, indicated schematically at 270, extend throughout bore hole 26 from the surface to agitator motor 264. The motor 264 may be suitably anchored at the bottom of sump bore hole portion 27. Thus, in addition to the pipe sections 246, the recovery tool string 28 also includes control and power lines 260 and 270 which extend from surface power and control facilities to the bottom of sump bore hole 27 for the purposes described.

In order to address the limits of lifting capability for compressed air supplied via manifold 248, one or more additional such manifolds may be employed as necessary at other locations closer to the surface in recovery tool string 28 to provide additional air transport action using the process of compressed air injection as above described. This air injection process is used throughout the length of the recovery tool string 28 in order to transport the coal and water slurry at suitable rates to be surface.

As noted above, the method of the present invention involves the use of a high pressure water jet impacting upon a subterranean mineral seam to dislodge mineral from the seam, the water providing a liquid medium to form a mineral and water slurry which flows down the grade of the sloping seam through previously worked sections and into a sump below the elevation of the mineral seam whereupon compressed air injection is utilized to transport the mineral and water slurry to the surface for further processing. The production tool string 20 as described permits remote operation from the surface with direct visual monitoring of the underground operation. The tool string is rotatable about its axis within a range sufficient to permit the water jet to be directed throughout an angle of sweep of at least approximately 140°. Further, the water stream outlet orifice is adjustable in a vertical plane throughout an angle of approximately 55°, from 10° below horizontal to 45° above horizontal, also by remote means operable from the surface.

The required angle of vertical adjustment for the water jet orifice is directly influenced by the trajectory of the water stream, which in turn in influenced by the water stream velocity at the outlet orifice. Water stream velocity, in turn, is influenced by the power of the apparatus utilized to pressurize the water, and by the diameter of the water outlet orifice. Some of the calculations relating to the relationship between water stream trajectory, velocity, nozzle area, and horsepower requirements for pressurizing the water follow immediately below.

Water Velocity at the nozzle: Vel. $= \sqrt{2\,gh}$ h = height of water column

| | | | | | | |
|---|---|---|---|---|---|---|
| PSI | 1000 | 2000 | 2500 | 3000 | 4000 | 5000 |
| h | 2307′ | 4614′ | 5767.5′ | 6927′ | 9228′ | 11535′ |
| V = | 385FPS | 545FPS | 606FPS | 667FPS | 770FPS | 862FPS |

$$\text{Nozzle Area} = \frac{3.1416 \times \text{Dia.}^2}{4 \times 144} = \text{Sq. Ft.}$$

| | | | | |
|---|---|---|---|---|
| D = | 1.125 in. | 1.000 in. | 0.90 in. | .875 in. |
| A = | .00629 S.F. | .005454 S.F. | .00442 S.F. | .0041757 S.F. |

$$\text{Trajectory} = \frac{\text{Distance} \times 32.2 \times 12}{\text{Velocity}}$$

At 2000 PSI Vel. is 545 FPS;

$$\text{At } 50'\ T = \frac{50 \times 32.2 \times 12}{545} = 35.4''$$

At 2500 PSI Vel. is 606 FPS;

$$\text{At } 50'\ T = \frac{50 \times 32.2 \times 12}{606} = 31.88''$$

At 3000 PSI Vel. is 667 FPS; T = 28.9″

$$\text{HP at 2000 PSI} = \frac{\text{Noz. Area} \times \text{Vel.} \times 60 \times 7.48 \times 2000}{1714}$$

Nozzle Orifice Diameter

For 1.125 D; HP = 1968
For 1.000 D; HP = 1557
For 0.900 D; HP = 1268
For 0.875 D; HP = 1119

(At 3000 PSI the Trajectory is 28.9″ but the GPM increase results in an uneconomical horsepower requirement, i.e., 1323 to 2066 depending on the nozzle size.)

NOTE: HP within 1250 HP motor

Concerning the air transport of coal and water slurry to the surface from sump bore hole 27, it has been found 400′ that the efficiency of lifting drops to about 50% at a column height. Therefore, for deposits to be recovered from a sump hole more than 300′ below the surface, additional compressed air injection capacity will have to be introduced at intermediate points as discussed hereinabove in recovery tool string 28. Calculations relating to air transport of coal in the form of a water borne slurry are shown immediately below, together with calculations relating to anticipated production or recovery rates that can be achieved.

$$\text{For a vertical lift: Vol. of Air} = \frac{L}{B} \times \text{Log}\left(1 + \frac{S}{B}\right) \times 4$$

$L$ = Ft. in Feet
$B$ = Barometric Press. (Ft. of water)
$S$ = Submergence of the receiver below the bottom of the coal vein.

From prototype experience it is known that a jet stream of water can dislodge 0.49 tons per minute (0.49 tons=900#). The ratio of water to coal in the slurry will be developed as follows:

PRESSURE LOSS IN VERTICAL SUMP PIPE

-continued

| | |
|---|---|
| Sump hole depth | 650′ |
| Pipe length | 620′ |
| Pipe diameter | 10″ |
| Initial velocity in pipe | 103 FPS or 6180 FPM |

$$\text{Pressure Loss} = \frac{L\,v^2}{25000 \times 10} = \frac{620 \times 103^2}{250{,}000} = 26.3 \text{ PSI}$$

Work pressure available=100 PSI−26.3=73.7 PSI Using a 3″ pipe to take air down the vertical hole the calculated velocity in that pipe is $$\frac{950 \text{ CFM}}{0.15338} = 6{,}193 \text{ FPM}$$

Pneumatic design calls for 5000 FPM for heavy materials like wood chips or tree bark, so it was assumed that with heavier material the velocity should be increased proportionately to keep the weight per cubic foot in proper ratio with the available compressed air. Horsepower for the sump hole. The seam is 600′ below the surface and the bottom of the hole is 50′ below the bottom of the seam. The conveying pipe is 10″ Diameter. The water system will use 987 GPM—16.45 GPS. Weight of water then is 125 PPS. The weight of Coal at 900#/min or 15 PPS makes a total of 140#/Second. Delivery at 6193 FPM will arrive at the top of the hole in about 0.1001 min. or 6.007 Seconds. Weight in the pipe will be 841.18#. The horsepower to lift this load will be;

$$\text{HP} = \frac{840.90\# \times 6193 \text{ FPM}}{33{,}000} = 157.82$$

HP with friction=157.82′×1.20=189.38 (20% friction) Based on these calculations:

Coal in the mix (slurry) is 15#/sec.

$$\text{Product per min.} \frac{15 \times 60}{2000} = .45 \text{ TPM}$$

Production (3 sections)=0.45×3=1.45 TPM
Production/Day=1.45×60×8×3=1944 Tons
Production/Year=350×1944=680,400 Tons
Tons (allowing 25% for relocating)=680,400×0.75=510,300 Tons
More Conservatively:
Production/Day Assumes 100° Eff. At 80% Prod. Eff.=1555 Tn/Day
Also, potential production/Year of 320 Days=497,664 Tn/Year
But when we consider 25% for moving, production=373,200 Tons for 3 sections or 497,600 Tons for 4 sections each working 320 shifts or 1280 machine operating shifts for the total operation.

In accordance with the above description, we have invented a novel and improved mineral extraction and recovery method and apparatus for recovering deposits from sloping mineral seams in which conventional mobile machinery is unsuitable. Notwithstanding the description hereinabove of certain present preferred embodiments of the invention, it will be appreciated that various alternative and modified embodiments would occur to others versed in the art, once they were apprised of this invention. Accordingly, it is intended that the invention should be construed broadly in accordance with the scope of the claims appended hereto.

We claim:

1. A method for recovering mineral from a subterranean mineral seam comprising the steps of:
   (a) providing a first fluid as a fluid jet for impacting said mineral seam at a given location to dislodge mineral particles from said mineral seam;
   (b) creating an admixture of said mineral particles and said first fluid;
   (c) transporting said admixture by gravitational flow thereof to a second location below the elevation of said given location;
   (d) agitating said admixture adjacent said second location;
   (e) providing a second fluid at said second location having the property of buoyancy with respect to said first fluid such that said second fluid tends to rise spontaneously to the surface of said first fluid when said first and second fluids are mingled; and
   (f) transporting said admixture from said second location vertically upward toward the earth's surface by injecting said second fluid into said admixture adjacent said second location.

2. The method as set forth in claim 1 including the additional step of directing said fluid jet through a range of orientations with respect to said mineral seam to dislodge mineral particles from an extended portion of said mineral seam.

3. The method as set forth in claim 3 wherein said directing of said fluid jet through a range of orientations is remote directing by manipulation of said fluid jet from a location displaced from said given location.

4. The method as set forth in claim 1 wherein said injecting of said second fluid into said admixture additionally includes injecting said second fluid into said admixture adjacent a third location spaced vertically upward from said second location.

5. In an apparatus for dislodging mineral particles from a subterranean seam, the combination comprising:
   (a) an elongated tool string adapted to extend within a generally vertical bore hole into such a seam from a location remote from the seam;
   (b) fluid jet nozzle means carried by a portion of said tool string adjacent said seam and adapted to direct a fluid jet at such a seam for dislodging mineral particles therefrom;
   (c) fluid conveying means coextensive with said tool string to supply fluid flow to said nozzle means;
   (d) first remotely operable adjustment means cooperable with said nozzle for adjusting the orientation of such a fluid jet with respect to such a seam by rotation of said nozzle about a first axis extending longitudinally of said tool string; and
   (e) second remotely operable adjustment means cooperable with said nozzle for further adjusting the orientation of such a fluid jet with respect to such a seam by rotation of said nozzle generally about a second axis extending transversely of said first axis.

6. The combination as set forth in claim 5 additionally including visual monitoring means cooperable with said nozzle for visually monitoring the orientation of said nozzle with respect to such a seam at a location remote from such a seam.

7. The combination as set forth in claim 6 wherein said visual monitoring means includes video transmission means carried by said tool string at a location adjacent said nozzle, said video transmission means being movable concomitantly with said nozzle throughout rotation of said nozzle about at least one of said first and second axes.

8. The combination as set forth in claim 7 wherein said visual monitoring means further includes lamp means for lighting a portion of the field of view of said video transmission means.

9. The combination as set forth in claim 8 wherein said video transmission means includes fiber optic video transmission means.

10. The combination as set forth in claim 6 wherein said remote visual monitoring means includes analog indicia means which is visually observable at a location remote from such a seam, said analog indicia means being mechanically connected to said nozzle means to move concomitantly therewith throughout rotation of said nozzle means about said first axis.

11. The combination as set forth in claim 6 wherein said tool string includes fabricated pipe means which carries said nozzle and includes fluid flow passage means which forms a part of said fluid conveying means and enclosure means for carrying said remote visual monitoring means .

12. The combination as set forth in claim 11 wherein said fabricated pipe section further includes means for retaining with respect thereto elongated power supply means which is cooperable with said second remotely operable adjustment means to permit remote actuation of said remotely operable adjustment means, and an elongated signal transmission means cooperable with said remote visual monitoring means to permit powering of said remote visual monitoring means and transmission of signals from said visual monitoring means to a remote location.

13. The combination as set forth in claim 5 wherein said nozzle means includes a generally straight, cylindrical fluid flow conduit portion having spiral groove means formed therein, said spiral groove means being of a geometry effective to impart rotary movement to a stream of fluid passing through said nozzle means.

14. In an apparatus for transporting fluidized mineral matter vertically upward from a subterranean location, the combination comprising:

(a) elongated pipe means adapted to extend within a generally vertical bore hole;

(b) said pipe means having a lower end portion adapted to extend into a mass of such fluidized mineral matter to receive such fluidized mineral matter into said pipe means;

(c) powered agitator means disposed adjacent said lower ends portion for maintaining at least a portion of said mass of such fluidized mineral matter adjacent said lower end portion in a fluidized state;

(d) fluid injector means cooperable with said pipe means for injecting a pressurized fluid medium into such fluidized mineral matter received within said pipe means to carry said fluidized mineral matter upwardly within said pipe means; and (e) supply means for providing such a fluid medium under pressure to said injector means.

15. The combination as set forth in claim 14 wherein said injector means includes a plurality of aperture means for injecting a respective plurality of pressurized fluid medium streams into such fluidized mineral matter within said pipe means.

16. The combination as set forth in claim 15 wherein at least some of said plurality of aperture means are oriented to inject such pressurized fluid medium into such fluidized mineral matter in a direction diverging generally upward from horizontal.

17. The combination as set forth in claim 14 wherein said injector means includes a lower end extension of said pipe means having said lower end portion, a plurality of aperture means traversing said lower end extension of said pipe means in a generally radial direction, and manifold jacket means extending about the external periphery of said lower end extension to enclose said plurality of aperture means, said manifold jacket means being adapted to receive such pressurized fluid medium for distribution of such pressurized fluid medium to said aperture means for injection of such pressurized fluid medium through said aperture means into fluidized mineral matter contained within said lower end extension.

18. The combination as set forth in claim 17 wherein said aperture means extend radially inwardly of said lower end extension in a direction diverging upwardly from horizontal.

19. A method for recovering mineral from a subterranean mineral seam comprising the steps of:

(a) providing a first fluid as a fluid jet for impacting said mineral seam from a given location to dislodge mineral particles from said mineral seam;

(b) remotely directing said fluid jet through a range of orientations with respect to said mineral seam by manipulation of said fluid jet from a location displaced from said given location to dislodge mineral particles from an extended portion of said mineral seam;

(c) creating an admixture of said mineral particles and said first fluid;

(d) transporting said admixture by gravitational flow thereof to a second location below the elevation of said given location;

(e) providing a second fluid at said second location having the property of buoyancy with respect to said first fluid such that said second fluid tends to rise spontaneously to the surface of said first fluid when said first and second fluids are mingled; and (f) transporting said admixture from said second location vertically upward toward the earth's surface by injecting said second fluid into said admixture adjacent said second location.

20. The method as set forth in claims 3 or 19 wherein said location displaced from said given location is a location at the earth's surface.

21. The method as set forth in claims 3 or 19 wherein said remote operation includes visual monitoring of the orientation of said fluid jet with respect to said mineral seam from said location displaced from said given location.

22. The method as set forth in claim 21 wherein said visual monitoring of the orientation of said fluid jet with respect to said mineral seam includes visual monitoring of analog indicia means which is movable concomitantly with at least some movements of said fluid jet within said range of orientations to indicate at least some positions of said fluid jet within said range of orientations.

23. A method for recovering mineral from a subterranean mineral seam comprising the steps of:

(a) providing a first fluid as a fluid jet for impacting said mineral seam at a given location to dislodge mineral particles from said mineral seam;

(b) creating an admixture of said mineral particles and said first fluid;

(c) transporting said admixture by gravitational flow thereof to a second location below the elevation of said given location;

(d) providing a second fluid at said second location having the property of buoyancy with respect to said first fluid such that said second fluid tends to rise spontaneously to the surface of said first fluid when said first and second fluids are mingled; and (e) transporting said admixture from said second location vertically upward toward the earth's surface by injecting said second fluid into said admixture adjacent said second location, and further injecting said second fluid into said admixture adjacent a third location spaced vertically upward from said second location.

* * * * *